United States Patent [19]

Arnau et al.

[11] 4,110,262

[45] Aug. 29, 1978

[54] LIQUID DETERGENT COMPOSITION

[75] Inventors: José Luis Arnau, Wemmel; Christian Roland Barrat, Meise; Jean Wevers, Brussels, all of Belgium

[73] Assignee: The Procter & Gamble Company, Cincinnati, Ohio

[21] Appl. No.: 775,214

[22] Filed: Mar. 7, 1977

[30] Foreign Application Priority Data

Mar. 8, 1976 [GB] United Kingdom ..... 09257/76

[51] Int. Cl.[2] ..... C11D 1/825; C11D 1/831; C11D 7/50

[52] U.S. Cl. ..... 252/545; 252/135; 252/153; 252/526; 252/527; 252/535; 252/539; 252/540; 252/546; 252/554; 252/558; 252/559; 252/DIG. 1; 252/DIG. 14

[58] Field of Search ..... 252/89, 559, 545, DIG. 1, 252/DIG. 14, 550, 551, 554, 555, 548, 546, 142

[56] References Cited

U.S. PATENT DOCUMENTS

| | | | |
|---|---|---|---|
| 2,947,702 | 8/1960 | Coskie | 252/529 |
| 3,812,041 | 5/1974 | Inamorato | 252/89 |
| 3,849,347 | 11/1974 | Tokiwa et al. | 252/545 |
| 3,869,399 | 3/1975 | Collins | 252/118 |
| 3,876,563 | 4/1975 | Collins | 252/545 |
| 3,931,033 | 1/1976 | Löhr et al. | 252/122 |
| 3,953,380 | 4/1976 | Sundby | 252/543 |
| 3,985,670 | 10/1976 | Berg et al. | 252/117 |
| 3,985,687 | 10/1976 | Inamorato et al. | 252/551 |

FOREIGN PATENT DOCUMENTS

| | | | |
|---|---|---|---|
| 2,201,022 | 7/1972 | Fed. Rep. of Germany | 252/89 |

*Primary Examiner*—P.E. Willis, Jr.

[57] ABSTRACT

The present invention relates to liquid, concentrated, homogeneous, stable, heavy duty detergent compositions. Such compositions contain a polyethoxylated nonionic detergent compound, a minor amount of a polyacid having at least one pK value of at least 5.0, and a liquid carrier, whereby the pH of the liquid composition has a pH in the range between 6.0 and 7.5. The compositions can also contain mixtures of polyethoxylated nonionic detergent compounds, additional amounts of synthetic, anionic detergent compounds, minor amounts of brighteners, suds-regulating and pH-regulating agents, perfumes, dyes and other usual liquid detergent compound additives. Such compositions show enhanced cleaning performance, particularly on bleach-sensitive stains, and have excelled stability on storage.

4 Claims, No Drawings

LIQUID DETERGENT COMPOSITION

FIELD OF THE INVENTION

The present invention relates to liquid, concentrated, homogeneous, stable, heavy duty detergent compositions.

DESCRIPTION OF THE ART

To be satisfactory for washing or pre-treating and subsequent washing of heavily soiled fabrics, in particular cotton fabrics, liquid detergent compositions must contain an adequate concentration of detergent compounds. In addition, they must remain stable and homogeneous when subjected to various storage conditions and be designed for use in both horizontal (tumble drum type) and upright (vertical agitator type) washing machines and for topical application as well as for hand-washing.

Liquid, heavy duty detergent compositions containing a synthetic organic detergent compound, which is generally anionic, nonionic or mixed anionic-nonionic in nature; an inorganic builder salt; and a solvent, are disclosed, for example, in U.S. Pat. Nos. 2,551,634; 1,908,651; 2,920,045; 2,947,702; 3,239,468; 3,272,753; 3,393,154; 3,554,916; 3,697,451; 3,709,838; Belgian Pat. Nos. 613,165; 665,532; 794,713 and 817,267; British Pat. Nos. 759,877; 842,813; and German applications Nos. 1,617,119; 1,937,682; 2,327,861; 2,530,840; 2,361,448 and 2,362,114. These compositions frequently contain a hydrotrope or solubilizing agent to permit the addition of sufficient quantities of surfactants and usual builder salts to provide a reasonable volume usage/performance ratio. Others are substantially anhydrous liquid compositions containing an alkanolamine component (U.S. Pat. No. 3,528,925). Still others contain a soap component (U.S. Pat. Nos. 2,875,153 and 2,543,744).

As can be seen from the foregoing, a substantial effort has been expended in developing built and builder-free detergent compositions in liquid form. Yet, there are several problems associated with the art-disclosed compositions which render them less optimal for wide scale use, undesirable from an ecological standpoint in improperly treated sewage, objectionable from a performance point of view in cleaning both natural and synthetic fibers and subject to instability under severe storage conditions.

It has now been found that superior detergency, in particular with respect to bleach-sensitive stains, is obtained if a mixture of a major amount of soluble ethoxylated nonionic surfactant and a minor amount of a polyacid having at least one pK value of at least 5.0 is combined in a liquid vehicle or carrier, whereby the pH of the detergent composition is in the range of from 6.0 to 7.5.

It has also been found that liquid, concentrated, heavy duty detergent compositions containing a mixture of a major amount of the soluble ethoxylated nonionic surfactant and a minor amount of the polyacids, having a pH in the range of from 6.0 to 7.5, exhibit superior removal of bleach-sensitive stains by topical application and through-the-wash fabric cleaning.

In addition, it has been found that these liquid, concentrated, heavy duty detergent compositions exhibit good physical properties, remain homogeneous and stable under severe storage conditions and stand the addition of many usual adjuvants.

It is, therefore, an object of this invention to provide liquid, concentrated, heavy duty detergent compositions which exhibit excellent cleaning and superior removal of bleach-sensitive stains by topical application and through-the-wash fabric cleaning.

It is another object herein to provide liquid, concentrated, heavy duty detergent compositions which remain stable and homogeneous under severe storage conditions.

It is still another object herein to provide liquid, concentrated, homogeneous, stable, heavy duty detergent compositions acceptable from an ecological standpoint.

These and other objects are obtained herein, as will be seen from the following disclosure.

SUMMARY OF THE INVENTION

The present invention encompasses a liquid, concentrated, homogeneous, stable, heavy duty detergent composition containing:

(1) from about 20% to about 70% by weight of a soluble ethoxylated nonionic surfactant;

(2) from 0.10% to 1.25% by weight of a polyacid having at least one pK value of at least 5.0;

(3) balance: liquid carrier;

the pH of the detergent composition being between 6.0 and 7.5.

In a preferred composition aspect, the liquid composition comprises a surfactant mixture containing different soluble ethoxylated nonionic surfactants and optionally but preferably synthetic anionic surfactants in amount up to 50% by weight calculated on the total nonionic surfactant and synthetic anionic surfactant content.

In another preferred embodiment, the concentration of polyacid is between 0.25% and about 1.0% by weight.

In another preferred embodiment, the pH of the composition is in the range between 6.0 and 7.0.

In still another preferred embodiment, the polyacid has at least one pK value of at least 5.0 and preferably equal or above $x-1$, wherein $x$ represents the pH of the liquid composition.

DETAILED DESCRIPTION OF THE INVENTION

The properties of the compositions of the present invention are the result of a combination of different components and factors which have to be properly selected and correlated as described in detail below.

The Ethoxylated Nonionic Surfactant

The instant compositions contain as an essential component soluble ethoxylated nonionic surfactant.

Ethoxylated nonionic surfactants can be prepared by a variety of methods well known in the art. In general terms, such nonionic compounds are conventionally produced by condensing ethylene oxide, forming the hydrophilic moiety or ethenoxy chain, with a hydrocarbon having a reactive hydrogen atom, e.g., a hydroxyl-, carboxyl- or amino group, and forming the hydrophobic moiety, in the presence of acidic or basic catalysts. Such procedures result in the production of a product mixture comprising a number of nonionics of varying ethoxylate content. Therefore, the conventional designation of the number of ethylene oxide units "$m$" present per molecule of nonionic compound as designated, for example, in the general formula $R—A(CH_2CH_2O)_mH$, wherein R represents the hydrophobic moiety and A the group carrying the reactive hydrogen atom, is an indication of the average number of ethylene oxide units per molecule of nonionic compound according to a statistic distribution where the peak is situated around the "*m*" number.

The properties of the ethoxylated nonionics depend to a considerable extent on the hydrophilic moiety or average number of ethylene oxide units present. Most commercialy available ethoxylated nonionics are viscous liquids or soft pastes having in general from about 2 to about 20 to 24 ethylene oxide units in average.

The soluble ethoxylated nonionic surfactants useful in the compositions of the present invention include those compounds which are obtained by reacting an alcohol with ethylene oxide and which are soluble in the instant liquid compositions.

Ethoxylated nonionic compounds have a negative temperature coefficient of solubility in water, becoming less soluble at higher temperatures. Therefore, soluble in the instant liquid compositions means soluble at temperatures below about 35° C.

Usually, the ethoxylated nonionic surfactants are considered to include only those compounds which are soluble in water. There is a large number of ethoxylated nonionic compounds having detersive properties but which do not have enough hydrophilic character to be fully soluble in water but are dispersible in water. They can be solubilized in water, however, with the help of solubilizing agents such as lower aliphatic alcohols, by admixing highly soluble ethoxylated nonionic compounds or by hydrotropes. Therefore, soluble in the instant liquid compositions means soluble per se in water or soluble in the instant liquid composition.

The hydrophobic moiety of the soluble ethoxylated nonionic surfactants useful in the composition of the present invention can be derived from primary and secondary, straight or branched, saturated or unsaturated aliphatic alcohols having from about 8 to about 24, preferably from about 12 to about 20 carbon atoms. Another source is the alkylphenols wherein the alkyl group or groups have from 1 to about 12 carbon atoms, wherein at least one group has at least 6 carbon atoms and the total number of carbon atoms in the alkyl groups is at most about 15.

Primary alcohols can be derived from animal and vegetable oils and fats by, for example, hydrogenolysis of said oils, fats or corresponding fatty acids. They are substantially straight-chain or linear alcohols.

Primary alcohols can also be obtained from synthetic sources by different processes. The usual raw materials are polymers of lower alkylenes or olefins. According to the type of polymers, olefins, processes and process conditions, alcohols with a different degree of linearity or branching are obtained. The major part of the commercially available primary synthetic alcohols are prepared by either the "OXO" or "Ziegler" process.

Secondary alcohols are mostly obtained from synthetic sources, e.g., from olefins, either by direct hydration at high temperatures and pressures or hydrolysis of the intermediate sulfuric acid product; by oxidation of paraffins, etc.

Alkylphenols are obtained by reacting a phenol with an olefin thermally preferably in the presence of a catalyst, e.g., boron trifluoride. Xylenol and cresol can also be used instead of phenol.

Preferred for the compositions of the present invention are soluble ethoxylated nonionic surfactants derived from primary and secondary aliphatic alcohols.

The hydrophilic moiety of the nonionic compounds useful in the composition of the present invention is an ethenoxy chain consisting of from 2 to about 24 ethylene oxide units in average, depending upon hydrophobic character of the hydrocarbon group. Preferred are those ethenoxy chains containing at least about 4 ethylene oxide units.

Suitable examples of soluble ethoxylated nonionic surfactants can, for example, be prepared from aliphatic primary alcohols containing from 12 to 20 carbon atoms condensed with from about 4 moles to about 14 moles of ethylene oxide per mole of alcohol and mixtures thereof. Non-limiting, specific examples of soluble ethoxylated nonionic surfactants derived from straight chain primary aliphatic alcohols are: $C_{12}H_{25}$—O—$(C_2H_4O)_6$—H; $C_{16}H_{33}$—O—$(C_2H_4O)_9$—H; $C_{18}H_{35}$O—$(C_2H_4O)_9$—H; $C_{18}H_{37}$—O—$(C_2H_4O)_9$—H; $C_{14}H_{29}$—O—$(C_2H_4O)_9$—H; $C_{12}H_{25}$—O—$(C_2H_4O)_9$—H; $C_{12}H_{25}$—O—$(C_2H_4O)_4$—H; $C_{16}H_{33}$—O—$(C_2H_4O)_9$—H; tallow—O—$(C_2H_4O)_{11}$—H; $C_{11}H_{23}$—O$(C_2H_4O)_4$—H; $C_{16}H_{33}$—O$(C_2H_4O)_7$—H; and mixtures thereof. Non-limiting, specific examples of soluble ethoxylated nonionic surfactants derived from secondary aliphatic alcohols are: $C_{12}H_{25}CH(C_4H_9)$—O—$(C_2H_4O)_9$—H; $C_8H_{17}CH(C_4H_9)$—O—$(C_2H_4O)_{12}$—H; $(C_7H_{15})_2CH$—O—$(C_2H_4O)_6$—H; $C_{17}H_{35}CH(CH_3)$—O—$(C_2H_4O)_9$—H; $C_{14}H_{29}CH(C_3H_7)$—O—$(C_2H_4O)_9$—H; $C_{14}H_{29}CH(CH_3)$—O—$(C_2H_4O)_9$—H; and mixtures thereof. Non-limiting, specific examples of soluble ethoxylated nonionic surfactants derived from branched primary aliphatic alcohols are: $C_{10}H_{21}CH(CH_3)CH_2$—O—$(C_2H_4O)_9$—H; $C_{12}H_{25}$—$CH(CH_3)CH_2$—O—$(C_2H_4O)_{11}$H; $C_{15}H_{31}CH(CH_3)CH_2$—O—$(C_2H_4O)_9$—H; $C_{13}H_{27}CH(CH_3)CH_2$—$CH_2$—O—$(C_2H_4O)_9$—H; $C_{12}H_{25}CH(C_2H_5)$—$CH_2$—O—$(C_2H_4O)_9$—H; $(C_7H_{15})_2CH$—$CH_2$—O—$(C_2H_4O)_{12}$—H; $C_9H_{19}CH(C_8H_{17})CH_2$—O—$(C_2H_4O)_{12}$—H; $C_{13}H_{27}CH(C_4H_9)CH_2$—O—$(C_2H_4O)_{11}$—H; $C_{13}H_{27}CH$—$(C_3H_7)CH_2$—$CH_2$—$(C_2H_4O)_9$—H, and mixtures thereof. Non-limiting, specific examples of soluble ethoxylated nonionic surfactants derived from alkylphenols are $C_9H_{19}C_6H_4$—O—$(C_2H_4O)_9$—H; $C_{12}H_{25}C_6H_4$—O—$(C_2H_4O)_{12}$—H; $(C_9H_{19})(CH_3)C_6H_3$—O—$(C_2H_4O)_{12}$—H; $(C_{12}H_{25})(CH_3)_2C_6H_2$—O—$(C_2H_4O)_{11}$—H; $C_{12}H_{25}C_6H_4$—O—$(C_2H_4O)_6$—H; and mixtures thereof. Non-limiting, specific examples of mixtures of soluble ethoxylated nonionic surfactants consisting of slightly water-soluble and highly water-soluble compounds useful in the compositions of the present invention are: ½ mixture of $C_{12}H_{25}$—O—$(C_2H_4O)_5$—H and $C_{12}H_{25}$—O—$(C_2H_4O)_{12}$—H; 1/1 mixture of $C_{14}H_{29}$—O—$(C_2H_4O)_5$—H and tallow—O—$(C_2H_4O)_{11}$—H; 2/1 mixture of $C_{15}H_{31}$—O—$(C_2H_4O)_7$—H and tallow—O—$(C_2H_4O)_{11}$—H; 1/4 mixture of $C_{10}H_{21}$—O$(C_2H_4O)_3$—H and $C_{13}H_{27}CH(CH_3)CH_2$—O—$(C_2H_4O)_{10}$—H; 1/1/1 mixture of $C_8H_{17}CH(C_6H_{13})$—O—$(C_2H_4O)_6$—H; $C_{12}H_{25}CH(CH_3)CH_2$—O—$(C_2H_4O)_4$ and $C_{18}H_{37}$—O—$(C_2H_4O)_{15}$—H; 0.2/1/2 mixture of $C_9H_{19}C_6H_4$—O—$(C_2H_4O)_{9-H}$; $C_{15}H_{31}$—O$(C_2H_4O)_5$—H and $C_{18}H_{37}$—O—$(C_2H_4O)_{12}$—H; 2/1/1 mixture of $(CH_3)_3C(CH_2)_8CH_2$—O—$(C_2H_4O)_3$—H; $C_{16}H_{33}CH(CH_3)CH_2$—O—$(C_2H_4O)_{11}$—H and $C_{14}H_{29}CH(CH_3)$—O—$(C_2H_4O)_9$—H (all ratios being by weight).

A particularly preferred soluble ethoxylated nonionic surfactant is represented by a mixture of: (1) a primary aliphatic alcohol ethoxylate obtained from an alcohol, the hydrocarbyl chain of which contains at least 65% branched-chain structure and is obtained by hydroformylation of random olefins and has from about 14 to about 22, especially from 16 to 19 carbon atoms in the hydrocarbyl chain, and 8 to 14 moles of ethylene oxide; and (2) an alcohol ethoxylate derived from a primary alcohol with preferably 40% branched-chain structure and having from 9 to 15, especially from 12 to 15 carbon atoms in the hydrocarbyl chain, and 3 to 7 moles of ethylene oxide.

Adjunct Surfactants

The compositions herein can optionally contain various other adjunct surfactants, which can be used to perform specific cleaning, grease-emulsifying and suds-modifying functions. Such optional adjunct surfactants include synthetic anionic surfactants of the sulfonate and/or sulfate type, semipolar surfact active agents and fatty acid alkanolamides known in the art.

Synthetic anionic surfactants of the sulfonate type useful herein include paraffin sulfonic acid and olefin sulfonic acid having from 6 to about 20 carbon atoms in the hydrocarbon group; alkylbenzene sulfonic acids having from 8 to about 15 carbon atoms in the alkyl group; mixtures thereof; and their water-soluble salts.

The preferred synthetic anionic surfactant component useful in the instant detergent compositions is a water-soluble salt of an alkyl-benzene sulfonic acid, preferably an alkanol amine alkylbenzene sulfonate, having from about 12 to about 15 carbon atoms in the alkyl group. More specifically, the most preferred synthetic anionic surfactant herein consists of a mono-, di- or triethanolamine salt of a straight chain alkylbenzene sulfonic acid in which the alkyl group contains in average about 12 carbon atoms.

Specific examples of alkylbenzene sulfonic acids and of the corresponding alkanolamine salts useful in the instant invention include decylbenzene sulfonic acid and triethanolamine decylbenzene sulfonate, triethanolamine dodecyl benzene sulfonate, diethanolamine undecyl benzene sulfonate, tridecylbenzene sulfonic acid and monoethanolamine tridecylbenzene sulfonate, triethanolamine tetradecylbenzene sulfonate- and tetradecylbenzene sulfonic acid, and mixtures thereof. Said mixtures of acids and salts can, if necessary, be adjusted to regulate the pH of the compositions. A particularly preferred surfactant mixture for use in the compositions of this invention comprises a soluble nonionic surfactant which is a mixture of: (1) a primary aliphatic alcohol ethoxylate wherein the hydrocarbyl chain contains at least 65% branched chain structure and has from about 14 to about 22, especially from 16 to 19, carbon atoms and containing 8 to 14 moles of ethylene oxide; and (2) an alcohol ethoxylate derived from a primary alcohol with preferably 40% branched-chain structure and having from 9 to 15, especially from 12 to 15 carbon atoms in the hydrocarbyl chain, and 3 to 7 moles of ethylene oxide; and a synthetic anionic surfactant which is an ethanolamine alkylbenzene sulfonate having from about 9 to about 15 carbon atoms in the alkyl chain.

The concentration of the adjunct synthetic anionic surfactant of the sulfonate type useful in the instant composition should be below 50% by weight, preferably below 20% by weight, calculated on the total amount of soluble ethoxylated nonionic surfactant and synthetic anionic surfactant taken together.

Semi-polar surfactants useful herein include water-soluble amine oxides containing one alkyl moiety of from about 10 to 24 carbon atoms and two moieties selected from the group consisting of alkyl moieties and hydroxyalkyl moieties containing from 1 to about 3 carbon atoms. Specific examples of semi-polar surfactants are: dodecyldimethylamine oxide; dodecyldiethylamine oxide; tetradecyldi(hydroxyethyl)amine oxide; and mixtures thereof.

Alkyl sulfates useful herein are the water-soluble salts, in particular the ethanolamine salts of sulfated higher alcohols especially those obtained by sulfating fatty alcohols containing from about 10 to 18 carbon atoms. Ethoxylated alkyl sulfates useful herein are the water-soluble salts, preferably the ethanolamine salts of sulfuric acid esters of the reaction product of one mole of a higher fatty alcohol, e.g., tallow or coconut alcohols, most preferably lauryl, myristyl or palmityl alcohols, and 1 to about 15, preferably from about 1 to about 6 moles of ethylene oxide per mole of fatty alcohol.

The concentration of the adjunct surfactants of the semi-polar type and the sulfate, including ethoxylated sulfate, type in the instant compositions can be up to 50% by weight calculated on the total amount of soluble ethoxylated nonionic and anionic surfactant compounds taken together. In certain compositions it may be desirable to incorporate below 10%, preferably below 5% by weight, calculated on the amounts of soluble ethoxylated nonionic surfactants, of these semi-polar, sulfate and ethoxylated sulfate types of adjunct surfactants.

When adjunct surfactants are present in the compositions of this invention, the total amount of surfactant should not be more than 70% by weight of the total composition.

The Polyacids

The second essential component of the compositions of the present invention is a polyacid having at least one pK value of 5.0 or higher.

An acid can be defined as a compound capable of accepting a pair of electrons to form a co-ordinate bond (G. N. Lewis definition), or as a compound furnishing a proton (Brönsted-Lowry definition), or simply as a hydrogen-containing substance which dissociates on solution in water producing one or more hydrogen ions.

Acids can be classified as monobasic, dibasic, tribasic, etc., according to the number of hydrogen atoms contained in the compound, replaceable by bases or dissociable in water.

As acids dissociate on solution in water, they can be characterized by their dissociation constant (which is to a certain degree dependent upon the temperature of the solution medium or water). The practical dissociation constant, usually indicated as and represented by the symbol pK, is expressed as the negative logarithm of the dissociation constant. Dibasic, tribasic acids produce 2, respectively 3 protons on solution in water; hence, they can be characterized by their 2, respectively 3 pK values. Generally, said pK values are defined at ambient temperatures, i.e., 10°–30° C.; but, since the changes in pK values for a given acid hardly differ if measured either at 10° or 30° C, the temperature at which the pK's are measured are of minor importance with respect to the present invention, provided they are within said range of about 10° to about 30° C.

Thus, the second essential component of the compositions of the present invention is a polyacid having at least one pK value of 5.0 or higher, if measured at a temperature within the range of from about 10° to about 30° C.

The polyacids useful in the present invention can be either organic, i.e., containing carbon atoms in the molecule and having preferably a —COOH group as proton donor, or inorganic. Specific non-limiting examples of useful polyacids having at least one pK value of 5.0 or higher are (between brackets the temperatures at which the dissociation constants are measured); see for example, Handbook of Chemistry and Physics, published by the Chemical Rubber Publishing Co., Cleveland, Ohio, 50th Edition, pp. 1753, etc.):

ascorbic acid, pK: 4.10 and 11.79 (24°, 16° C);
aspartic acid, pK: 3.86 and 9.82 (25° C);
citric acid, pK: 3.08, 4.74 and 5.40 (18° C);
cyclohexane-1,1-dicarboxylic acid, pK: 3.45 and 6.11 (25° C);
cyclopropane-1,1-dicarboxylic acid, pK: 1.82 and 7.43 (25° C);
dimethylmalic acid, pK: 3.17 and 6.06 (25° C);
diglycollic acid, pK 3.4 and 5.11;
glutaric acid, pK: 4.34 and 5.41 (25° C);
o-hydroxybenzoic acid, pK: 2.97 and 13.40 (19°, 18° C.);
m-hydroxybenzoic acid, pK: 4.06 and 9.92 (19° C);
p-hydroxybenzoic acid, pK: 4.48 and 9.32 (19° C);
itaconic acid, pK: 3.85 and 5.45 (25° C);
maleic acid, pK: 1.83 and 6.07 (25° C);
malic acid, pK: 3.40 and 5.11 (25° C);
methylsuccinic acid, pK: 4.13 and 5.64 (25° C);
o-phthalic acid, pK: 2.89 and 5.51 (25° C);
succinic acid, pK: 4.16 and 5.61 (25° C);
o-phosphoric acid, pK: 2.12, 7.21 and 12.67 (25° C., 25° C., 18° C.);
pyrophosphoric acid, pK: 0.85, 1.49, 5.77 and 8.22 (25° C.);
$Na_2H_2P_2O_7$, pK: 0.86, 1.96, 6.68 and 9.39 (25° C.);
nitrilotriacetic acid, pK: 3.03, 3.07 and 10.7 (25° C.);
ethylene diamine tetraacetic acid, pK 2.0, 2.7, 6.2 and 10.3;
ethylenediaminotetramethylenephosphonic acid, pK: -, -, 3, 5.2, 6.5, 8.1, 10.2 and 12.0 (25° C.).

and mixtures thereof.

Preferred are polyacids whereby at least one pK value is at least 5.5 or, with reference to the pH of the compositions, have at least one pK value which is equal to or above $x-1$ wherein $x$ represents the pH of the liquid composition, thus whereby for a composition having a pH of 6.8, has a pK value of at least 6.8 - 1 = 5.8 or higher.

Most preferred polyacids are those having at least two pK values of 5.0 or higher and more particularly, with reference to the pH of the composition, have at least two pK values of $x-1$ or higher ($x$ = pH of the composition), thus whereby for a composition having a pH of 6.5, they have at least two pK values of 6.5 - 1 = 5.5 or higher.

Specific, non-limiting examples of preferred polyacids useful in the composition of the present invention are diglycollic acid, nitrilotriacetic acid and citric acid. Specific non-limiting examples of most preferred polyacids useful in the composition of the present invention are $Na_2H_2P_2O_7$, pyrophosphoric acid, orthophosphoric acid and ethylene diamine tetraacetic acid. Another class of most preferred polyacid species for use herein comprises organophosphonic acids, particularly alkylene polyamino polyalkylene phosphonic acids, inclusive of ethylene diamine tetramethylene phosphonic acid; hexamethylene diamine tetramethylene phosphonic acid; diethylene triamine pentamethylene phosphonic acid; and aminotrimethylene phosphonic acid.

The polyacids can be added as such into the compositions of the present invention or in the form of their water-soluble salts or semi-salts, e.g., as $H_4P_2O_7$, $Na_2H_2P_2O_7$, or $Na_4P_2O_7$. It may be necessary, however, to add pH-regulating agents, well known in the art, to adjust the pH of the compositions.

The pH

An essential condition of the present invention is that the compositions have a pH within the range of from 6.0 to 7.5, preferably between about 6.0 and 7.0.

Compositions containing the essential components of the present invention, but having a pH below 6.0 become difficult to process and are unstable, particularly if they contain stilbene-type brighteners, in addition they become less attractive because unsafe for topical application.

Compositions containing the essential components of the present invention but having a pH above 7.5 lose their effectiveness with respect to removal of bleach-sensitive stains.

Liquid Carrier

As liquid carrier, water, organic solvents, and mixtures thereof, can be used.

Compositions containing the above-described essential surfactants, polyacids and water will remain liquid and stable under most circumstances, particularly if the soluble ethoxylated nonionic surfactant has a relatively long ethenoxy chain, i.e., wherein the number of ethoxy units is at least equal to or higher than half the number of carbon atoms of the hydrophobic moiety.

The liquid carrier used in the instant compositions may comprise water and an organic solvent. The organic solvent may comprise up to about 50% of the total liquid carrier used in the compositions.

The organic solvents, which should not chemically react with any of the components of the instant compositions, are selected from the group consisting of lower aliphatic alcohols having from 2 to 6 carbon atoms and 1 to 3 hydroxyl groups; ethers of diethylene glycol and lower aliphatic mono-alcohols having from 1 to 4 carbon atoms; and mixtures thereof.

Hydrotropes selected from the water-soluble salts of alkylbenzene sulfonic acids having up to 3 carbon atoms in the alkyl groups are also useful in compositions of this invention.

Suitable examples of lower aliphatic alcohols useful in the instant compositions are ethanol, n-propanol, isopropanol and butanol; 1,2-propanediol, 1,3-propanediol, and n-hexanol. Useful examples of glycol ethers are monomethyl-, -ethyl-, -propyl-, and monobutyl ethers of diethylene glycol; and mixtures thereof. Other organic solvents having a relatively high boiling point and low vapor pressure could also be used, provided they do not react with any of the other ingredients present.

Suitable examples of hydrotropes that can be used in the instant compositions are the water-soluble alkylaryl sulfonates having up to 3 carbon atoms in an alkyl group such as sodium, potassium, ammonium and ethanol amine salts of xylene-, toluene-, ethylbenzene- and isopropylbenzene sulfonic acids. They are preferably used in compositions containing, in addition, a synthetic, anionic surfactant of the sulfonate type. Hydrotropes can conveniently be considered as part of the liquid carrier of the composition since the hydrotrope will necessarily dissolve therein.

In the preferred compositions, the liquid carrier is an aqueous mixture, wherein the amount of organic solvent, preferably ethanol, propanol, isopropanol, sodium salt of cumene sulfonic acid, and mixtures thereof, is between 2% and 15% by weight of the total composition.

Concentration and Ratios

Heavy duty liquid detergent compositions, to be suited for the washing of the heavily soiled fabrics, require high concentrations of surfactants of powerful cleansing effect. They must exhibit a high degree of stability upon storage over a period of months under different temperature conditions. They must be free-flowing from the receptacle as manufactured and after aging. They must be homogeneous in compositions at the time of use to ensure the addition of the proper amount and ratio of the components.

The physical and cleaning properties of the instant compositions are the result of mutual effect of the different components in proper ratios. Therefore, it is the key to stability, pourability, homogeneity and cleaning effectiveness, that the essential surfactants be present in specific ratios and sufficient concentration.

The instant compositions are specifically designed to provide optimum cleaning benefits when used either as pre-treatment agents, preferably applied in highly concentrated form directly onto the fabric stains, in particular onto bleach-sensitive stains, prior to washing, or as detergents for conventional through-the-wash fabric laundering operations. Hence, highly concentrated, liquid, stable, homogeneous detergent compositions, which can be topically applied onto stains as such, and can be conveniently added to the washing liquors, provide a clear formulation advantage.

The instant compositions remain liquid, stable, homogeneous with a surfactant content variable within the range of from about 20% to about 70% by weight, with the balance being primarily the minor amount of polyacids and the liquid carrier.

Preferred compositions contain at least about 25% by weight of soluble ethoxylated nonionic surfactant in order to ensure proper greasy stain removal performance in both pre-treatment or topical application and through-the-wash utilization of the instant compositions.

Most preferred are compositions containing at least about 25% by weight of soluble ethoxylated nonionic surfactant and up to 25% by weight of an synthetic anionic surfactant of the sulfonate type and wherein the total amount of surfactants is below about 60% by weight.

The amount of polyacids present in the instant compositions is critical and must be, with reference to the acid form, within the range of from 0.10% to about 1.25% by weight, calculated on the total weight of the composition. Preferably, the amounts of polyacids vary in the range between 0.25% and 1.0% by weight, whereby, most preferably, the concentration is inversely related to the pK value or values that are above 5.0. Compositions having the appropriate amount of soluble ethoxylated nonionic surfactant and a pH between 6.0 and 7.5, but having a concentration of polyacids below 0.10% by weight, hardly provide any detergency effect on bleach-sensitive stains. By increasing the concentration of polyacids beyond 1.25% by weight, no additional detergency effect via topical application will be obtained, particularly on bleach-sensitive stains, while phase separation of the composition occurs and precipitation of some polyacids, particularly of inorganic acids, can take place.

Optional Components

An optional component of the instant compositions in an alkanolamine compound. The free alkanolamine useful herein, in particular to adjust the pH of the compositions, is selected from the group consisting of mono-, di- and triethanolamine, and mixtures thereof; preferred is the triethanolamine. The amount of alkanolamine which can be added can be up to 5% by weight, but is preferably below 2% by weight.

A desirable component for addition herein is a suitable opacifier. An opacifier contributes to create a uniform appearance of the compositions of this invention. Examples of suitable opacifiers include polystyrene commercially known as LYTRON 621 and LYTRON 607 manufactured by Monsanto Chemical Corporation. It has been found that the LYTRON opacifiers can be incorporated in the compositions of this invention only in presence of polyacid, i.e., the opacifier precipitates in the compositions herein which do not contain the polyacids.

Another optional component of the instant compositions is an aliphatic carboxylic acid as suds-controlling agent, having from 12 to 24, preferably from 16 to 22 carbon atoms. Its concentrations should not exceed 2.5% by weight and preferably be restricted to at most 1.5% by weight, calculated on the total weight of the composition.

Another optional but preferred component is a silicone-based suds-controlling and regulating agent. A heavy duty liquid detergent composition designed for use in both horizontal and vertical washing machines must have acceptable sudsing properties when used in either of these machines. The silicone-based suds-controlling and regulating agents useful herein can be alkylated polysiloxane materials of several types, in combination with solid materials such as solid silica, silica aerogels, xerogels and hydrophobic silicas of various types. Suitable examples of alkylated polysiloxanes are dimethylpolysiloxanes having a molecular weight of from about 200 to 200,000. Suitable examples of mixtures of alkylated siloxanes and solid silica have a siloxane/silica ratio of from 20:1 to 1:1, preferably 10:1 to 3:1. Concentrations of suds-controlling agents useful in the instant compositions can vary between 0.01% and 2%; preferably 0.05% and 0.2%.

A preferred suds-controlling agent herein comprises a mixture of (a) dimethylpolysiloxane and silica-aerogel in a 9:1 weight ratio emulsified in (b) a nonionic of the general formula $R'COO—(C_2H_4O)_p—H$, wherein R' is an aliphatic hydrocarbon chain having 10 to 22 carbon atoms and $p$ is a number of 300 to 2,000, in a weight ratio of (a) to (b) of from about 1:4 to 1:1, preferably about 1:2. Due to the pre-emulsification of the siloxane and silica, the preferred suds-controlling agent is easily dispersed in the instant compositions, and shows an extraordinary storage stability and suds-controlling effectiveness irrespective of the aging. Concentrations of the preferred silicone-based suds-controlling agents, preferably present in the instant compositions can be up to 0.5% by weight, preferably between 0.05% and 0.2% by weight.

Still other optional components include brighteners, fluorescers, antimicrobial agents and enzymes. Such components preferably comprise not more than about 3% by weight of the total compositions. One particular advantage of the instant compositions is that the hardly water-soluble brighteners and fluorescers can be added either directly to the compositions, i.e., as such, or during any step of the formulation process.

TESTS AND EXAMPLES

The following tests and examples illustrate the liquid detergent compositions of the present invention. The figures mentioned in the examples refer to percentages by weight. The abbreviations for the nonionic surfactants employed, e.g., $C_{12-15}(EO)_4$, are standard for such materials and $C_{12-15}$ describes the carbon atom content of the hydrophobic moiety of the molecule while $(EO)_4$ indicates the ethylene oxide unit content of the hydrophilic moiety of the molecule.

The effectiveness of the instant compositions, particularly with respect to bleach-sensitive stains, if compared to practically identical or commercially available detergent compositions, is illustrated below, whereby most tests have been carried out by means of a "Launder-Ometer" device and some have been duplicated under real washing conditions. The "Launder-Ometer" device is described, for example, in "Detergency, Theory and Test Methods" by N. G. Cutler and R. C. Davis, part I, pages 415–417 (edition 1972, Marcel Dekker, Inc., New York).

In all tests, stained swatches were used, prepared as follows: (1) cotton swatches, swatches of new but prewashed cotton (5 × 5 cm) were stained with red wine and tea respectively, by moistening them with 5 drops — Pasteur pipette — of red wine or 5 drops of tea obtained by boiling 15 gr. of tea for 15 minutes in 200 cc. of water, and aging for at least 24 hours at ambient temperature; (2) polyester/cotton swatches (65/35; 5 × 5 cm), swatches of new but prewashed polyester/cotton swatches were prepared in the same manner as the cotton swatches.

TEST A

The effectiveness on removal of bleach-sensitive stains by liquid compositions of the present invention, if compared to practically identical liquid compositions but without the essential polyacids, is illustrated by the following Test A.

A series of six liquid detergent compositions $A_1$–$A_6$ were prepared, consisting of:

| Components: | $A_1$ | $A_2$ | $A_3$ | $A_4$ | $A_5$ | $A_6$ |
|---|---|---|---|---|---|---|
| - triethanolamine salt of linear alkylbenzene sulfonic acid wherein the alkyl chain has in average 11.9 carbon atoms | — | — | — | 12 | 16 | 20 |
| - $C_{14-15}(EO)_4$ | 15 | 20 | 25 | — | — | — |
| - tallow $(EO)_{11}$ | 15 | 20 | 25 | — | — | — |
| - $C_{12-15}(EO)_4$derived from a primary alcohol with about 60% by weight of branched chain structure | — | — | — | 6 | 8 | 10 |
| - $C_{16-19}(EO)_{11}$derived from a primary alcohol with about 72% by wt of branched chain structure | — | — | — | 12 | 16 | 20 |
| - optical brightener (stilbene type) | 0.2 | 0.2 | 0.2 | 0.2 | 0.2 | 0.2 |
| - ethanol | 15 | 15 | 15 | 10 | 10 | 10 |
| - perfume, dyes | ← minors → | | | | | |

-continued

| Components: | $A_1$ | $A_2$ | $A_3$ | $A_4$ | $A_5$ | $A_6$ |
|---|---|---|---|---|---|---|
| - triethanolamine | ← to adjust pH → | | | | | |
| - water | ← balance → | | | | | |
| pH of the compositions | 7.0 | 7.0 | 7.0 | 7.0 | 7.0 | 7.0 |

Another series of six detergent compositions were prepared identical to the ones of the previous series except that 0.35% by weight of ethylenediaminotetramethylenephosphonic acid (EDTMP) was added. A jar of the "Launder-Ometer" device was filled with 0.2 liter of water (hardness: 3.14 millimoles/liter as $CaCO_3$) and about 1.6 gr. of the detergent product to be tested. Two cotton swatches stained with red wine and two cotton swatches stained with tea were pretreated by topical application of the product to be tested applied onto the stains (yielding a total amount of composition to be tested per jar of about 2.6 gr. or a concentration of about 1.3% by weight). For each composition $A_1$–$A_6$, two jars were prepared as described. The 12 jars were placed in the "Launder-Ometer" and the temperature raised up to 60° C over a period of 40 minutes. Subsequently, the swatches were rinsed for about 3 minutes under running tap water (temperature about 17° C.) and line-dried. The line-dried swatches were then visually graded by two graders working independently, using a 0–5 scale (under Northern standard daylight; 0 = no removal of the stain, 5 = complete removal). Thereafter, all the results of both graders were pooled. The results are given in Table I.

TABLE I

| Compositions | First series without EDTMP | Second series with 0.35% EDTMP |
|---|---|---|
| $A_1$ | 2.85 | 4.2 |
| $A_2$ | 2.8 | 4.4 |
| $A_3$ | 2.65 | 4.2 |
| $A_4$ | 4.1 | 4.75 |
| $A_5$ | 4.0 | 4.7 |
| $A_6$ | 3.9 | 4.8 |

Thus the bleach-sensitive stain removal performance of the compositions of the present invention, i.e., containing a small amount of a polyacid, is significally superior over practically identical compositions but containing no polyacid.

TEST B

A series of six liquid detergent compositions were prepared consisting of:

| Components | $B_1$ | $B_2$ | $B_3$ | $B_4$ | $B_5$ | $B_6$ |
|---|---|---|---|---|---|---|
| - triethanolamine salt of a linear the alkyl chain averages 11.9 carbon atoms in length | 20 | 20 | 20 | 20 | 20 | 20 |
| - $C_{14-15}(EO)_7$ | 30 | 30 | 30 | 30 | 30 | 30 |
| - optical brightener (stilbene type) | ← 0.2 → | | | | | |
| - triethanolamine | ← to adust pH → | | | | | |
| - ethanol | 15 | 15 | 15 | 15 | 15 | 15 |
| - perfumes, dyes | minors | | | | | |
| - water | balance | | | | | |
| - ethylenediaminotetramethylene-phosphonic acid (EDTMP) | — | — | 0.35 | 0.35 | — | — |
| - citric acid | — | — | — | — | 0.5 | 0.5 |
| pH | 7.0 | 6.5 | 7 | 6.5 | 7.0 | 6.5 |

These compositions $B_1$–$B_6$ were tested in exactly the same way and under the same conditions as the compositions $A_1$–$A_6$ described in Test A. The stained swatches were similar to those of Test A and they were graded in the same way too. The pooled results are given in Table II.

TABLE II

| Compositions | $B_1$ | $B_2$ | $B_3$ | $B_4$ | $B_5$ | $B_6$ |
|---|---|---|---|---|---|---|
| gradings | 1.8 | 2.3 | 4.0 | 4.5 | 2.6 | 3.45 |

From Table II, follows: the superiority of compositions $B_3$–$B_6$ formulated according to the present invention over the compositions $B_1$ and $B_2$; the correlation between the pH of the composition and the pK value of the acid which is above 5 but within one unit of the pH of the composition, i.e. for citric acid having pK values of 3.08, 4.74 and 5.40, the effectiveness is more pronounced with a composition having a pH of 6.5 ($B_6$) than with a composition having a pH of 7 ($B_5$); and the effectiveness of polyacids as EDTMP having more than one pK value above 5.0 ($B_3$ and $B_4$ are more effective than $B_5$ or $B_6$.)

TEST C

The influence of the pK values of the polyacids on the bleach-sensitive stain removal performance in correlation with the pH of the detergent composition is illustrated by the following Test C.

A series of six liquid detergent compositions were prepared $C_1$–$C_6$, identical to the composition $A_6$, except that compositions $C_2$–$C_6$ contained in addition the following polyacids:

$C_1 = A_6$ (thus no polyacid)
$C_2 = A_6 + 1\%$ by weight of $Na_2H_2P_2O_7$ (pK: 0.86; 1.96; 6.68; 9.39)
$C_3 = A_6 + 1\%$ by weight of citric acid (pK : 3.08; 4.74; 5.40)
$C_4 = A_6 + 0.5\%$ by weight of nitrilotriacetic acid (pK : 3.03; 3.07; 10.7)
$C_5 = A_6 + 0.5\%$ by weight of glycolic acid (pK : 3.83)
$C_6 = A_6 + 0.5\%$ by weight of adipic acid (pK : 4.43; 4.41).

The pH of all compositions was 7.0.

Each of these compositions $C_1$–$C_6$ was tested under exactly the same conditions as the compositions $A_1$–$A_6$ in Test A.

The line-dried cotton swatches were graded by two graders independently and the results of all stains and all swatches were pooled. The bleach-sensitive stain removal performance of each composition is given in Table III.

TABLE III

| Compositions | $C_1$ | $C_2$ | $C_3$ | $C_4$ | $C_5$ | $C_6$ |
|---|---|---|---|---|---|---|
| Gradings | 1.25 | 3.90 | 2.75 | 3.25 | 1.00 | 0.75 |

The superiority in bleach-sensitive stain removal performance of compositions $C_2$, $C_3$ and $C_4$, formulated according to the present invention, over compositions $C_5$ and $C_6$ containing similar amounts of a polyacid ($C_6$) but with pK values below $x-1$, or a monoacid ($C_5$), is evident.

TEST D

The present test shows the effectiveness of removal of bleach-sensitive stains (wine, tea) via topical application by compositions of the instant invention containing no bleaching agents versus commercially available granular detergent compositions.

A series of five detergent compositions $D_1$–$D_5$ were prepared and tested, being:

$D_1$ : identical to composition $A_6$ of Test A;

$D_2$ : identical to $D_1$ but containing 0.35% by weight of ethylenediaminotetramethylenephosphonic acid (EDTMP);

$D_3$ : identical to $D_1$ but containing 1% by weight of citric acid;

$D_4$ and $D_5$ : commercially available granular detergent compositions consisting of (in % by weight)

| Components | $D_4$ | $D_5$ |
|---|---|---|
| - sodium salt of linear alkylbenzene sulfonic acid wherein the alkyl chain has 11.9 carbon atoms in average | 9.3 | 8.1 |
| - tallow $(EO)_{11}$ | 3.4 | 0.8 |
| - hydrogenated fatty acid derived from fish oil having 16 to 22 carbon atoms | 3.4 | 1.7 |
| - sodium tripolyphosphate | 35.0 | 67.0 |
| - sodium silicate ($SIO/Na_2O$) | 6.0 | — |
| - brightener (stilbene type) | 0.2 | 0.25 |
| - sodium carboxymethyl cellulose (100%) | 0.8 | 1.5 |
| - perfume | 0.2 | 0.2 |
| - ethylenediaminotetraacetic acid sodium salts | 0.2 | 0.2 |
| - $Na_2SO_4$ | 13.5 | 6.0 |
| - sodium perborate | 25.0 | — |
| - polyethyleneglycol condensate (average molecular weight about 400) | 0.2 | 0.2 |
| - miscellaneous | 1.0 | 1.0 |
| - proteolytic enzyme* | 0.2 | 0.2 |
| - moisture | balance | |

*proteolytic enzyme: "ALCALASE" made by Novo Industri A/S, Copenhagen, Denmark, containing about 6% by weight of active enzyme material.

Test D with compositions $D_1$-$D_5$ is carried out in the "Launder-Ometer" device under exactly the same conditions as described in Test A, with the same number of wine- and tea stained cotton swatches, except that 2.6 gr. per jar of each granular detergent $D_4$ respectively $D_5$ is presolubilized in 0.2 liter of water just prior to the test (no topical application with the presolubilized granular composition). The rinse and line-dried swatches are then graded by two graders as described in Test A and all the results pooled. The pooled results are given in Table IV.

TABLE IV

| Compositions | $D_1$ | $D_2$ | $D_3$ | $D_4$ | $D_5$ |
|---|---|---|---|---|---|
| Gradings | 2.45 | 4.85 | 3.60 | 4.90 | 3.50 |

TEST E

Test E shows the effectiveness of compositions of the present invention under real washing conditions.

The following series of four detergent compositions $E_1$–$E_4$ were prepared and tested:

$E_1$ : identical to the granular composition $D_4$;

$E_2$ : identical to composition $A_6$ of Test A, but containing 0.5% by weight of citric acid and having a pH of 6.5;

$E_3$ : identical to composition $A_6$ of Test A, but containing 0.35%, by weight of EDTMP (pH = 7);

$E_4$ : identical to $E_2$ but containing 1% by weight of $Na_2H_2P_2O7$ instead of citric acid (pH 5.65).

In addition, compositions $E_2$, $E_3$ and $E_4$ contained about 0.9% by weight of a fatty acid having 16 to 22 carbon atoms. With each of these compositions $E_1$–$E_4$, four loads of about 3 kg each of domestic soiled laundry were washed in a horizontal drum-type washing machine (MIELE 416S).

Each load contained in addition two cotton and two polyester/cotton swatches (10 × 10 cm), stained with tea, coffee and red wine respectively (staining: by 5 drops — Pasteur pipette — of red wine on cotton swatches and 5 drops on polyester/cotton swatches; with tea: 5 drops of a mixture obtained by boiling 15 grams of tea for 5 minutes in 200 cc. of water, on cotton swatches and 5 drops on polyester/cotton swatches; with coffee: 5 drops of a mixture obtained by boiling 25 gr. of coffee for 5 minutes in 200 cc. of water, on cotton swatches and 5 drops on polyester/cotton swatches; aging: at least 24 hours at room temperature.

Each of the stains on the swatches (12 in total tested with compositions $E_2$, $E_3$ and $E_4$) were each pretreated with about 1 gr. of the liquid composition to be tested (i.e., about 12 gr. in total per load) and about 108 gr. of the detergent compositions $E_2$–$E_4$ were added into the respective washing liquors (resulting in a total concentration of about 0.60% by weight). The swatches washed with test composition $E_1$ were not pretreated but the total concentration of composition $E_1$ was also 0.6% by weight.

These loads of domestic soiled laundry and swatches were washed at once in the main wash cycle of the washing machine in about 20 liters of water (hardness : 3.14 millimoles/liter as $CaCO_3$). The temperature of the washing liquor was raised to about 60° C. over a period of 25 minutes and kept at that temperature for an additional 30 minutes. After dilution of the washing liquor, evacuation of the diluted liquor and rinsing of the load (five cycles with about 10 liters of water; hardness of water : 3.14 millimoles/liter; temperature 19°–16° C; and spinning) all swatches were removed, line-dried, and the dried swatches visually graded by two graders working independently, using a 0–5 scale (0 = no removal of the stain; 5 = complete removal). Thereafter, all results of the graders with respect to the stains on cotton and polyester/cotton swatches were pooled. The results are given in Table V hereafter.

The same test was repeated with the compositions $E_2$–$E_4$, all conditions being identical, except that none of the swatches were pretreated and 120 gr. of each of the compositions $E_2$–$E_4$ tested were added directly into the washing liquor. The line-dried swatches were again graded as described previously but whereby the results with respect to the cotton swatches and polyester/cotton swatches were pooled separately. The results are given in Table V.

TABLE V

| Swatches | Washing Procedure | Compositions $E_1$ | $E_2$ | $E_3$ | $E_4$ |
|---|---|---|---|---|---|
| polyester/ cotton | with pretreatment | — | 4.63 | 4.79 | 4.66 |
| | without pretreatment | 4.30 | 3.64 | 4.53 | 3.95 |
| cotton | with pretreatment | — | 3.37 | 4.44 | 4.37 |
| | without pretreatment | 4.36 | 2.73 | 3.66 | 3.00 |

From this Table V, it follows that compositions of the present invention are — at the same concentration — as good on bleach-sensitive stain removal, without pretreatment, than a heavily built granular detergent compositions containing a considerable amount of bleaching agent, and have superior effect on bleach-sensitive stain removal if — using the same total concentration of the detergent compositions — there is pretreatment by topical application.

| | I | II | III | IV | V | VI | VII | VIII | IX | X |
|---|---|---|---|---|---|---|---|---|---|---|
| Monoethanolamine salt of linear alkylbenzene sulfonic acid having in average 11.9 carbon atoms in the alkyl group | 16.2 | — | — | — | — | — | — | — | 20 | — |
| Triethanolamine salt of linear alkylbenzene sulfonic acid having in averate 11.9 carbon atoms in the alkyl group | — | 15 | 20 | 25 | 20 | 20 | 20 | 20 | — | 20 |
| $C_{17-19}(EO)_{11}$ (about 25% branched)* | — | — | — | — | 20 | — | — | — | — | — |
| $C_{16-19}(EO)_{11}$ (about 72% branched) | 20 | 15 | 20 | 25 | — | — | — | — | 20 | — |
| $Tallow(EO)_{11}$ | — | — | — | — | — | 20 | — | — | — | — |
| $C_{12-15}(EO)_{11}$ (about 50% branched) | — | — | — | — | — | — | 30 | — | — | 20 |
| $C_{14-15}(EO)_4$ | — | — | — | — | 10 | 10 | — | — | — | — |
| $C_{12-15}(EO)_4$ | 10 | 5 | 10 | 15 | — | — | — | — | — | — |
| $C_{9-11}(EO)_8$ | — | — | — | — | — | — | — | — | 20 | — |
| $C_{14-15}(EO)_7$ | — | — | — | — | — | — | — | 30 | — | — |
| $C_{12-15}(EO)_3$ | — | — | — | — | — | — | — | — | — | 10 |
| Ethanaol | 8.5 | 10 | 10 | 12 | 15 | 15 | 13 | 6 | 10 | 7 |
| Brightener (Stilbene type) | | | | | | 0.2 | | | | |
| Perfume, dyes | | | | | | 0.35 | | | | |
| EDTMP** | — | 0.35 | — | — | 0.5 | — | 0.3 | 0.25 | 0.35 | — |
| Citric acid | 0.5 | — | — | 1 | — | — | 0.3 | 0.1 | — | 0.75 |
| EDTA*** | — | — | 0.5 | — | — | 0.75 | — | — | — | — |
| Triethanolamine | 0.75 | 0.78 | 0.5 | 1.2 | 1 | 1.50 | 0.85 | 0.6 | 0.7 | 1.3 |
| Water | | | | | | balance | | | | |
| pH of the composition | 6.5 | 7 | 6.2 | 6.75 | 7.3 | 6.7 | 7 | 7.2 | 6.8 | 6.9 |

*25% branched = about 25% of the alkyl chains are branched.
**EDTMP = ethylenediaminotetramehylenephosphonic acid.
***EDTA = ethylenediaminotetraacetic acid.

What we claim is:

1. A liquid, concentrated homogenous stable heavy duty liquid detergent comprising:

(a) from about 20% to about 70% by weight of the composition of a soluble ethoxylated nonionic surfactant selected from the group consisting of ethoxylated alcohols containing from about 2 to about 24 moles of ethylene oxide wherein the alcohol is selected from the group consisting of:

(i) straight and branched chain primary and secondary, saturated and unsaturated, aliphatic alcohols having from about 8 to about 24 carbon atoms in the hydrocarbyl group thereof, and (ii) alkyl phenols wherein the alkyl group or groups have from about 1 to about 12 carbon atoms, wherein at least one alkyl group has at least 6 carbon atoms and wherein the total number of carbon atoms in the alkyl groups is at most about 15; and mixtures thereof;

(b) from about 0.10% to about 1.25% by weight of the composition of a polyacid selected from the group consisting of : ethylenediamine tetramethylene phosphonic acid, hexamethylene diamine tetramethylene phosphonic acid, diethylene triamine pentamethylene phosphonic acid and aminotrimethylene phosphonic acid; and (c) the balance of the composition being a liquid carrier; wherein the pH of the product is from 6.0 to 7.5.

2. A composition according to claim 1 which in addition comprises an anionic adjunct surfactant selected from the group consisting of an alkylbenzene sulfonic acid having from about 8 to about 15 carbon atoms in the alkyl group, a n-paraffin sulfonic acid having from about 6 to about 20 carbon atoms, water soluble salt of said sulfonic acids, and mixtures thereof, whereby the adjunct anionic surfactant represents below 50% by weight of the total of the soluble ethoxylated nonionic surfactant and the adjunct anionic surfactant.

3. A composition in accordance with claim 1 which in addition comprises from 0.01% to about 2% by weight of a silicone suds-regulating agent.

4. A composition in accordance with claim 1 wherein the ethoxylated nonionic surfactant is represented by a mixture of :

(1) a primary aliphatic alcohol ethoxylate obtained from an alcohol, the hydrocarbyl chain of which contains at least 65% branched-chain structure and has from about 16 to 19 carbon atoms, and from 8 to 14 moles of ethylene oxide;

(2) an alcohol ethoxylate derived from a primary alcohol having from 12 to 15 carbon atoms in the hydrocarbyl chain and from 3 to 7 moles of ethylene oxide.

* * * * *